US005577538A

United States Patent [19]

Sunderhaus et al.

[11] Patent Number: 5,577,538

[45] Date of Patent: Nov. 26, 1996

[54] LIQUID DISPENSING NOZZLES HAVING IMPROVED VIEW GLASS/FLOW INDICATORS

[75] Inventors: Charles A. Sunderhaus, Hamilton; Jonathan P. Young, West Chester; David A. Oberrecht; Charles J. Moorman, both of Cincinnati, all of Ohio

[73] Assignee: Dover Corporation, New York, N.Y.

[21] Appl. No.: 349,203

[22] Filed: Dec. 5, 1994

[51] Int. Cl.[6] ..... B67D 5/32

[52] U.S. Cl. ..... 141/94; 141/206; 141/392; 116/273; 116/276; 116/DIG. 7

[58] Field of Search ..... 141/94, 95, 96, 141/392, 206; 116/273, 274, 276, 264, DIG. 7; 222/40

[56] References Cited

U.S. PATENT DOCUMENTS

| | | | |
|---|---|---|---|
| 2,587,839 | 3/1952 | Grise | 226/66 |
| 4,993,460 | 2/1991 | Robinson et al. | 141/94 |
| 5,197,523 | 3/1993 | Fink, Jr. et al. | 141/206 |
| 5,244,017 | 9/1993 | Hartman et al. | 141/94 |
| 5,249,707 | 10/1993 | Simpson et al. | 222/40 |

*Primary Examiner*—Henry J. Recla
*Assistant Examiner*—Steven O. Douglas
*Attorney, Agent, or Firm*—Kinney & Schenk

[57] ABSTRACT

A fuel dispensing nozzle is provided with a view glass/fuel flow indicator that are disposed between the main fuel valve and a downstream check valve. The view glass/flow indicator means comprise a pair of horizontally aligned view glasses. A plurality of embodiments illustrate the use of different sub-assemblies in providing the view glass/flow indicator functions, as well as different provisions for obtaining a seal that prevents leakage of fuel at the view glass units.

43 Claims, 7 Drawing Sheets

LIQUID DISPENSING NOZZLES HAVING IMPROVED VIEW GLASS/FLOW INDICATORS

The present invention relates to improvements in liquid dispensing nozzles of the type employed in delivering fuel to the fuel tanks of automobiles and similar vehicles and, more particularly to view glass/flow indicators that enable the liquid being delivered to be observed by the user of the nozzle and further to provide the user with a visual indication that the liquid is actually being delivered.

A view glass may be generally characterized as a portion of a fluid flow conduit, which is defined by a glass member, of a member formed of a transparent material, thus providing for visual inspection of the fluid in the conduit. It is a common practice to provide flow indicating means that are visible through the glass member and usually give an indication of the rate of fluid flow, as well as the fact that the fluid is flowing.

The following exemplify prior art view glass/flow indicators for visually monitoring the flow and discharge of liquids in a liquid handling system.

U.S. Pat. No. 1,730,127 shows an oil pump having a chamber, defined in part by a glass tube, through which oil flows. Balls, within the chamber, are randomly displaced by the oil, as it flows through the chamber.

U.S. Pat. No. 2,847,969 shows a flow indicator that is connected, at its opposite ends, to fluid flow conduits. The indicator includes a spherical chamber, the upper portion of which is defined by a transparent member that is convexly, curved in a hemisphere configuration. A vaned ball is disposed in the spherical chamber, alternatively a plurality of balls can be disposed in the chamber. Flow through the indicator is directed generally tangentially into the chamber to impart movement to the ball or balls.

Other view glass/flow indicators off similar import include U.S. Pat. Nos. 2,884,891; 4,105,095; 4,745,877 and 4,819,577.

The present invention is more specifically directed to the provision of view glass/flow indicators in nozzles employed in delivering fuel into vehicle fuel tanks, most widely exemplified by the nozzles employed at retail gasoline stations.

In the early days of gasoline retailing, visual inspection of the gasoline was facilitated by dispensers which included an elevated chamber from which gasoline flowed into the fuel tank of a vehicle. This chamber was defined in part by a glass tube that enabled gasoline quality to be readily observed. Additionally, it was a common practice to provide a view glass/flow indicator at the dispenser. A hose chen extended from the view glass/flow indicator to a nozzle that was used in filling a vehicle fuel tank. Such view glass/flow indicators are exemplified in U.S. Pat. Nos. 1,287,985; 1,730,118; 1,865,002 and 2,387,805.

The present invention is further and more specifically directed to the monitoring of fuel flow through a dispensing nozzle. This approach to flow monitoring has the advantage of being readily observable by the user of the nozzle.

There are but limited prior art teachings of flow monitoring at a fuel dispensing nozzle, known to applicants.

U.S. Pat. No. 2,587,839 discloses a fuel nozzle that includes flow indicator means that are solely audible. That is, fuel flow rotates an externally mounted striker that impinges a bell. While an indicium of fuel flow is provided, there are several shortcomings. In addition to the obvious failure to enable visual inspection of the fuel, the bell arrangement is expensive and bulky, as well as being heavy and awkward.

U.S. Pat. No. 2,231,907 discloses a flow indicator of sorts. A view glass is provided in a nozzle spout. The view glass provides visual access to a small chamber into which fuel is drawn when the level of fuel in a vehicle fuel tank fill pipe reaches the level of the distal end of the spout that is inserted into the fill pipe. This gives a visual warning enabling the flow of fuel to be shut off before the fill pipe overflows. Modern automatic shut-off nozzles have obsoleted the need for this type of visual overfill warning.

U.S. Pat. No. 4,993,460 teaches a standard nozzle configuration in which a main shut-off, poppet valve is mounted on a generally vertical axis and urged to a closed position by a spring disposed thereabove. This standard popper configuration is modified by providing a view glass in the removable cap that is provided to facilitate assembly of the main poppet and the compression spring that urges the poppet to a closed position. Balls, or a spinner, mounted beneath the view glass provide flow indicating means.

The teachings of the '460 patent do meet, in general terms the need of providing a view glass/flow indicator that may be readily viewed while a vehicle fuel tank is being filled. These teachings, however, do have shortcomings and have the potential for creating a hazard.

Reference to a possible hazard deals with the fact that should there be a structural failure with respect to the view glass, or any seals associated with its being incorporated into the poppet spring cap, then the pressurized fuel upstream of the dispenser is free to escape onto the vehicle, the user of the nozzle, and the adjacent area of the filling station. This uncontrolled escape of fuel will continue, unabated, until the pump that is pressurizing the fuel is shut off. This uncontrolled release of fuel is both a fire hazard and an environmental hazard.

Accordingly, the broad object of the present invention is to provide a nozzle for dispensing fuels, or other hazardous liquids, which incorporates an improved view glass/flow indicator.

Another and related object of the invention is to reduce the risk of an uncontrolled release of fuel in providing a view glass/flow indicator for a fuel dispensing nozzle.

A further object of the invention is to enhance the visibility of a flow indicator in a view glass.

Yet another object of the present invention is to minimize, if not eliminate, leakage of fuel by way of the means employed in mounting a view glass/flow indicator on a fuel nozzle.

Still another object of the present invention is to provide a view glass/flow indicator within the confines of a standard nozzle construction, that is, to do so with minimum modification of the nozzle body component of a nozzle.

Still another object of the present invention is to attain the foregoing ends in a manner that facilities the provision of a vapor recovery, return flow path, that extends in overlying relation to the fuel flow path in the body portion of the nozzle.

Yet a further object of the present invention is to attain the foregoing ends in a simple and economical fashion.

The foregoing ends may be broadly attained by a fuel dispensing nozzle comprising a nozzle body, one end of which is adapted for connection with a fuel hose. A spout projects from another end of the nozzle body for the discharge of fuel from the nozzle. A fuel passage extends through the nozzle body, from the inlet end to and through the spout for discharge of fuel therefrom. A main valve controls the flow of fuel through the fuel passage.

View glass/flow indicator means enable visual inspection of the fuel flowing through the fuel passage and provide a visual indication that fuel is being discharged from the nozzle spout and at what rate.

This basic nozzle is characterized in that the view glass/flow indicator means define, in part, the fuel passage and are disposed downstream of the main valve.

The same nozzle may comprise a check valve downstream of the main valve, and be further characterized in that the view glass/flow indicator means is disposed intermediate the main valve and the check valve, whereby the view glass/flow indicator means, disposed in or forming part of the fuel passage is wetted by fuel at all times during normal operation of the nozzle.

This nozzle may further comprise a spring for urging the main valve to a closed position, manually controlled means for opening the main valve against the force of the spring, and means for automatically closing the main valve to prevent over-filling of a vehicle tank. Such automatic closing means include a generally vertically disposed pin that is disposed in a generally, longitudinal plane, centrally of the fuel flow passage. The nozzle body has a pin housing portion in which the pin is disposed. The fuel passage is split for fuel flow around the housing portion. The split flow passage is rejoined, downstream of the housing portion for flow past the check valve.

This valve is further characterized in that the view glass/flow indicator means is disposed intermediate the main valve and the pin housing portion.

In attaining the ends of the present invention, the referenced basic nozzle may also be characterized in that the view glass/flow indicator means comprise a pair of view glasses, disposed in generally aligned relation and, respectively, defining opposed portions of the flow passage. It is thus possible for light to pass through the fuel passage, to enhance visual inspection of the fuel and observation of the flow indicator means.

In attaining other ends of the present invention, the referenced basic nozzle may also be characterized in that the view glass/flow indicator means define, in part, the fuel passage, and the view glass/flow indicator means comprise a pair of view glasses; disposed in generally horizontally aligned relation and, respectively, defining opposed portions of the flow passage. Light may thus pass from one side of the nozzle body to the other, through the fuel passage, to enhance visual inspection of the fuel and observation of the flow indicator means.

This nozzle is further characterized in that the view glass/flow indicator means comprise flow indicator means comprising a single rotor.

In attaining additional objects of the invention, the referenced basic nozzle may be characterized in that the view glass/flow indicator means comprise a pair of view glasses, disposed in generally aligned relation and, respectively, defining opposed portions of the flow passage. Light is thus able to pass through the fuel passage, to enhance visual inspection of the fuel and observation of the flow indicator means.

Additionally this nozzle is characterized in that the view glass/flow indicator means comprise a cage extending between the view glasses and permitting flow of fuel therethrough, when the main valve is open. At least one solid member, disposed within the cage is movable in response to flow of fuel through the cage to provide a visual indication of fuel flow.

Other features of the invention include the provision of a vapor return flow path that overlies the fuel flow path through the nozzle body, with the view glass/flow indicator means disposed beneath the vapor flow path.

Another feature of the invention is found in the provision of subassemblies that comprise a transparent disc and flow indicator. These subassemblies are mounted, respectively, in horizontally aligned openings in opposed sides of the nozzle body defining the fuel flow passage downstream of the main valve.

Other features of the invention are found in providing sealing means between the transparent discs of the view glasses and the openings in the nozzle body.

The above and other related objects and features of the invention will be apparent from a reading of the following description of the invention, with reference to the accompanying drawings, and the novelty thereof pointed out in the following claims.

IN THE DRAWINGS

FIGS. 1–4

Figure 1:
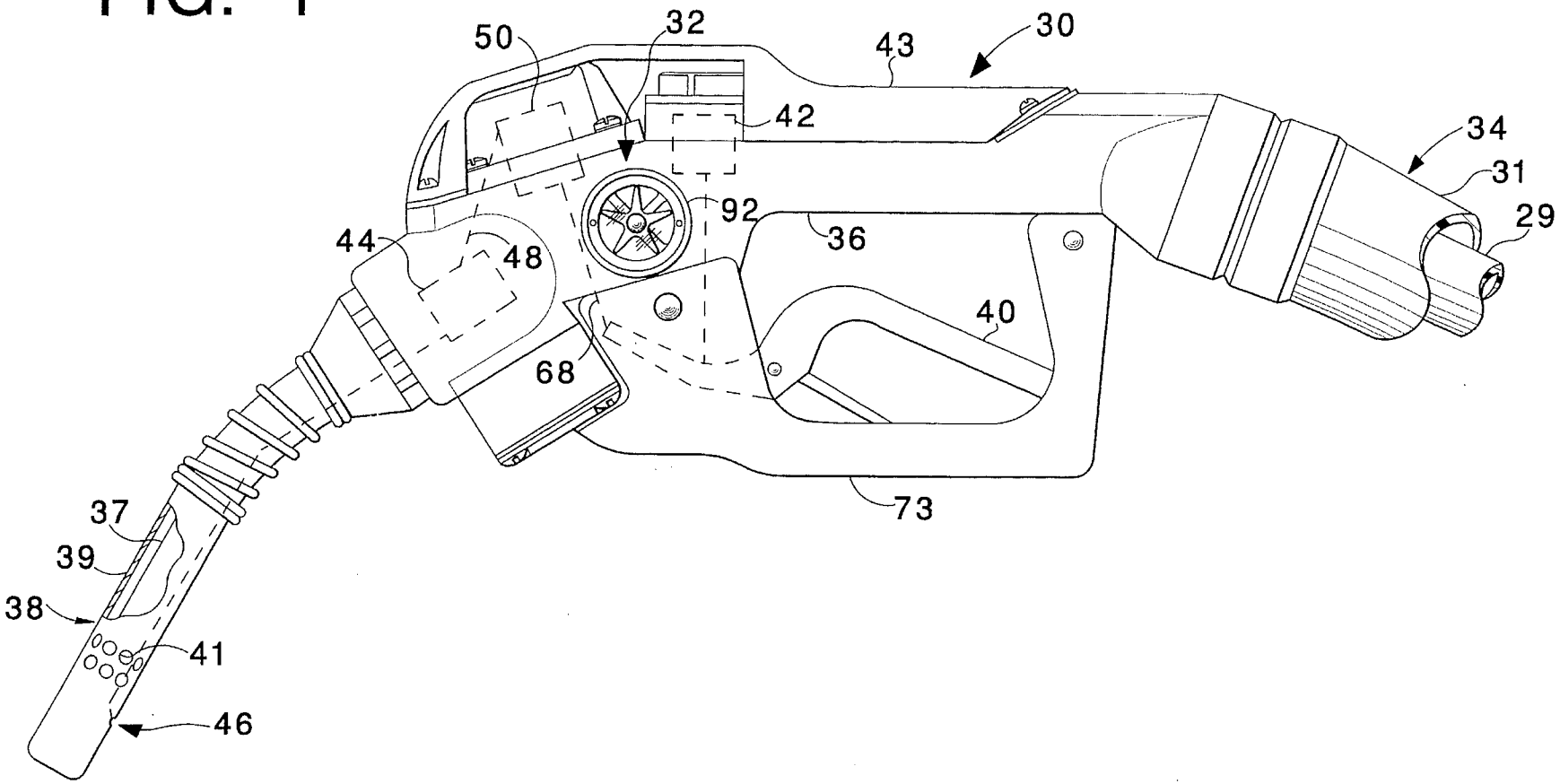
FIG. 1 is an elevation of a fuel dispensing nozzle, embodying the present invention and generally oriented as it would be in filling the fuel tank of a vehicle.

FIG. 1 illustrates a fuel dispensing nozzle, indicated generally by reference character 30, which includes a view glass, flow indicator embodying the present invention and indicated generally be reference character 32.

The nozzle 30 is adapted for attachment to a coaxial hose 34, which, comprises a flexible, inner tube 29 and a flexible, outer tube 31. The coaxial hose extends to a dispenser where the tube 29 is connected to a source of pressurized fuel. The tubes 29 and 31 define part of a vapor recovery passageway, which connects, at the dispenser, with conduit means for returning recovered vapor to a point of disposal, usually the storage tank from which fuel is drawn for delivery by the nozzle.

The nozzle 30 comprises a body 36 and a spout 38. The coaxial hose is connected to the inlet end of the body 36. The spout 38 is mounted on the opposite end of the nozzle body and jointly therewith, defines a fuel flow path which extends from the connection with tube 29 to the distal end of the spout, from which fuel is discharged longitudinally into the fill pipe of a vehicle fuel tank.

The spout is also comprised of a pair of tubes, 37, 39. The tube 37 defines the discharge end of the fuel flow path. The annular space between the tubes 37, 39 defines the initial portion of the vapor return flow path, the inlet to which is provided by holes 41 in the tube 39, adjacent the distal end of the spout 38. The vapor return flow path extends from the spout 38 through a vapor cap 43 to the inlet end of the nozzle body 36, where it connects with the annular, vapor return passage in the coaxial hose 34. A vacuum source is provided in the dispenser, or elsewhere to draw fuel vapors into the holes 41, during delivery of fuel, and then return them to a disposal location, thereby minimizing atmospheric pollution.

The structural details of the nozzle body 36, two tube spout 38 and vapor return path cap 43 and the vapor and fuel flow paths defined thereby are more fully disclosed in copending U.S. application Ser. No. 986,521 Filed: Dec. 7, 1992 which is of common assignment with the present application, reference is made thereto for further details, which are herein incorporated by reference.

Figure 2:
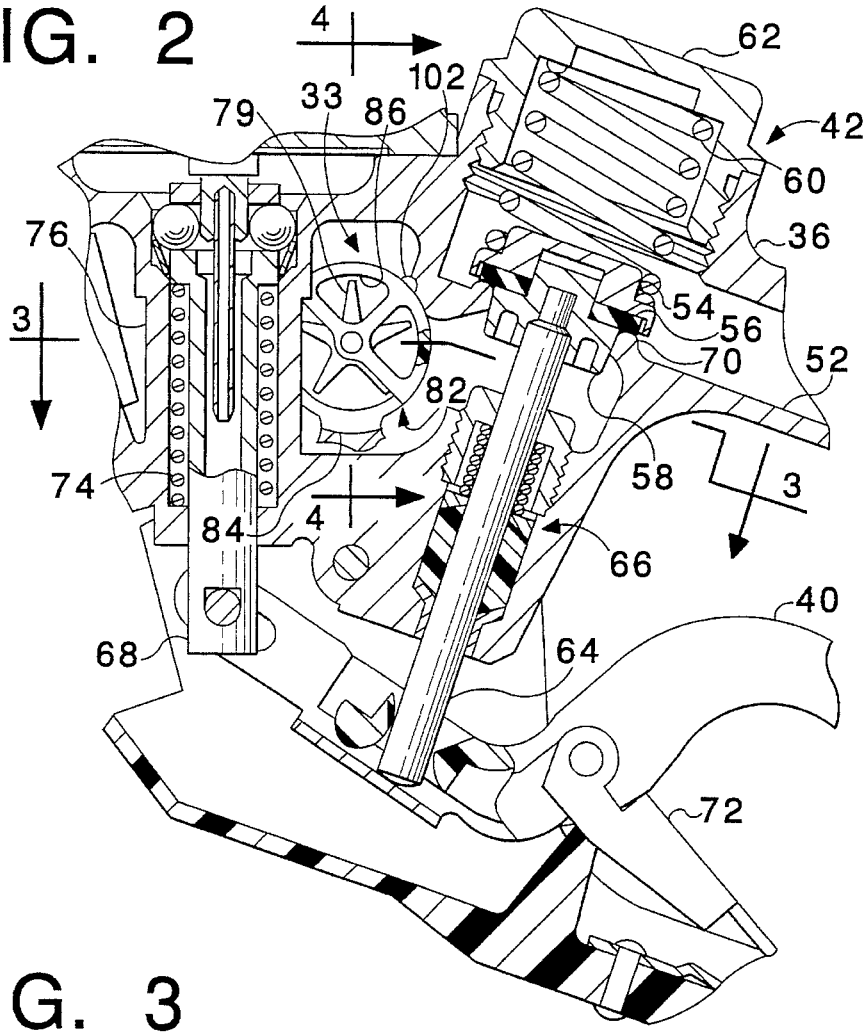
FIG. 2 is a longitudinal section, on an enlarged scale, through the nozzle of FIG. 1, illustrating the view glass/flow indicator construction of the present invention.

Flow of fuel is controlled by a lever 40, which is manually pivoted about its inner end, to open a main poppet valve 42 (see also FIG. 2). The pressurized fuel then flows through a venturi check valve 44, which is biased to a closed position so that, normally, there will be fuel in the flow passage between the main popper 42 and the venturi check valve 44.

The venturi check valve 44 is a part of means for automatically shutting off fuel flow to prevent overfilling of a vehicle fuel tank. The vacuum generated by flow of fuel through the venturi check valve 44 is normally vented through a passageway that opens, at 46, on the exterior of the spout 38, adjacent its distal end. When fuel in the vehicle fill pipe rises to block the vent opening 46, a vacuum signal 48 is transmitted to a latching or trip mechanism 50. This signal causes the lever 40 to lose its effectiveness in maintaining the main poppet open. Thereupon the main poppet closes to interrupt the fueling operation and prevent overfilling of the vehicle fuel tank.

The structure for operating the main poppet is more fully shown in FIG. 2 where the fuel flow passage is indicated by reference character 52. The main poppet valve 42 comprises a sealing disc holder 54, a sealing disc 56 and a skirt 58. A spring 60 is compressed between the sealing disc holder 54 and a cap 62 that is threaded into the body 36. A stem 64 extends from the skirt 58 downwardly, through a packing assembly 66, through the body 36 to be engaged with the lever 40.

The lever 40 is pivotally connected to the lower end of a trip stem 68, which is normally latched in the illustrated, upper position, by the latching mechanism 50. With the stem 68 so latched, the lever 40 may be pivoted upwardly to raise the disk 56 from an annular valve seat 70, that defines a valve opening, which forms a continuation of the passage 52.

When there is a vacuum signal input (48) to the latching mechanism 50, the force of spring 60 is sufficient to pivot the lever in a counterclockwise direction so that the disc 56 will engage the seat 70. This automatic closure of the popper valve 52 is had whether the right hand end of the lever 40 is manually held in an elevated position or whether it is so held by a latching member 72. The nozzle 30 further comprises a lever guard 73 which supports a rack that is engaged by the latching member 72 to maintain the lever in a valve open position.

It is to be noted that the trip stem 68 and a spring 74 (which returns the trip stem 68 to its upper position for reengagement by the latching mechanism) are isolated from the fuel flow path, being mounted within a tubular housing 76, which spans the fuel passage 52. The fuel passage 52 thus directs fuel from the hose 34 through the main popper 42 (when it is open), around opposite sides of the trip stem housing 76 (FIG. 3) and then through the venturi check valve 44 for discharge from the spout 38.

Aside from the view glass/flow indicator 32, the nozzle 30, as described to this point, is a well known construction for providing an automatic shut-off feature in the delivery of fuel into the fuel tank of a vehicle. A further description of the nozzle components is not required for an understanding of the present invention.

For a further description of the features of the nozzle relating to its fuel dispensing and vapor recovery functions, reference is made to the above referenced U.S. patent application Ser. No. 986,521.

Before describing, in detail, the view glass/flow indicator 32, it will be further noted that the fuel passage 52, between the main poppet 52 and the venturi check valve 44, and the split flow of fuel around the trip stem housing 76 is a well known and widely accepted configuration for attaining a compact construction incorporating the fuel flow control and automatic shut-off functions in a fuel nozzle. One of the objects of the present invention is to attain the desired end of providing the flow indicating function, within the spatial constraints of this accepted, flow passage configuration.

The view glass, flow indicator 32 comprises view glass/flow indicator units 33, on opposite sides of the fuel flow path 52. Preferably these units are provided in horizontally aligned relationship, on opposite sides of nozzle body 36. Each view glass/flow indicator unit 33 comprises a rotor 78, having vanes 79, which is rotatably mounted on a horizontally disposed pin 80. The pin is supported by a cage 82. The cage 82 comprises a ring portion 84 and an inwardly projecting semicircular, deflector portion 86 extending into the flow passage 52, from the ring portion 84. Integral spokes 88 projecting radially inwardly from the deflector portion 86 to a hub 90 on which the pin 80 is mounted.

The rotor 78, pin 80 and cage 82 comprises a subassembly that is inserted through a counterbored opening in the vertical side wall of the body 36, on one side of the flow passage 52. The description relative to the subassembly on one side of the nozzle body is equally applicable to the other side and will not be duplicated. Suffice it to say that the view glass/flow indicator unit 33 on one side nozzle body is identical with that on the other side, though identicality is not required to enjoy the benefits of the broader aspects of the invention.

Figure 15:
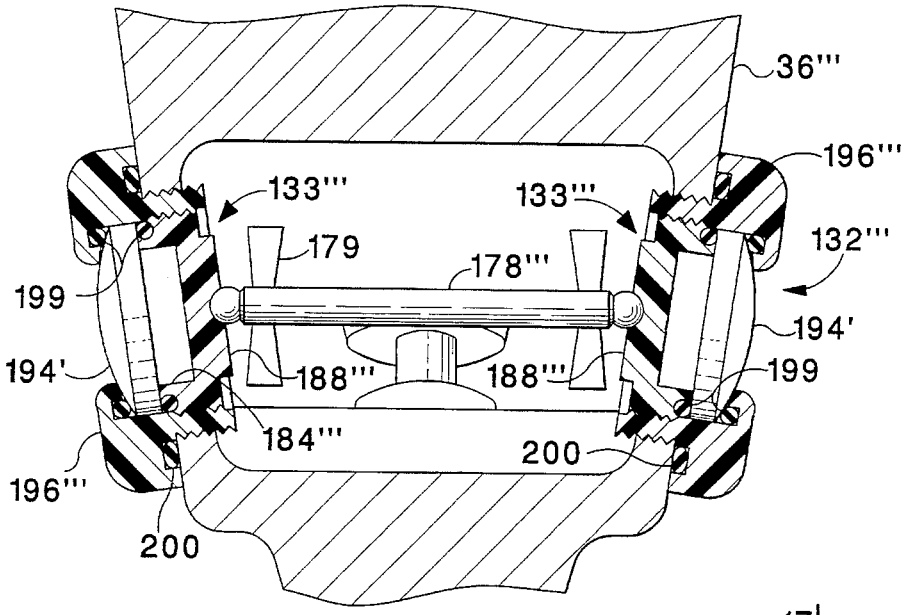
FIG. 15 is section similar to FIG. 10, illustrating a further modification to the embodiment of FIGS. 11 and 12.

In the conventional configuration of nozzle bodies, this portion of the side wall is angled (see FIG. 15). This standard body configuration has been modified, in this embodiment of the invention, by the provision of bosses 92 (FIGS. 3 and 4) on opposite sides of the nozzle body 66 so that the subassemblies may be coaxially aligned and their rotors 78 rotate on a common axis.

The inner surface of the ring portion 84 is positioned against the counterbore for the opening through which flow indicating subassembly is inserted. A transparent disc 94 overlies the outer end face of the ring portion 84. The term "view glass" is used in the sense its being a member that is transparent to permit objects to be view through it. The disc 94 may be formed of glass, which is preferred, but may also be formed of transparent, resinous materials which are stable when exposed to fuels.

A retaining ring 96 (FIG. 4) is threaded into the boss 92 and bears against the transparent disc 94 to force it against the ring portion 84 and thus clamp the ring portion 84 against the counterbore. The retaining ring 96 is provided with holes 98, which may be engaged by a spanner wrench to rotate the ring during assembly or disassembly.

Not only is the described view glass flow indicator unit readily and easily assembled, it is provided with a highly effective liquid seal through the use of a single O-ring 100.

Figure 4:
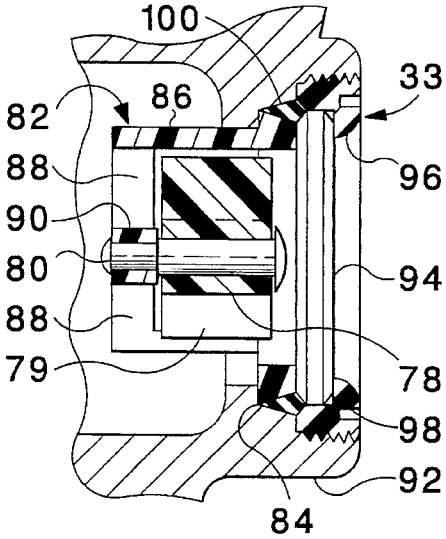
FIG. 4 is a fragmentary section, on a further enlarged scale, taken on line 4—4 in FIG. 2.

As best seen in FIG. 4, the outer, circumferential surface of the ring portion 84 is angled away from the bore in which it is received. The bore is similarly angled away from the ring portion, thus compositely defining an outwardly open, V-shaped groove. The transparent disc 94 has a beveled, inner edge. The retaining ring 96 is provided with an outwardly angled surface, which, with the beveled edge of the disc 94, compositely defines an innerwardly opening, V-shaped groove. The O-ring 100, having a conventional circular cross section, is positioned between these V-shaped grooves in the initial assembly of these components. As the retaining ring 94 is threaded to its illustrated, fully assembled position, the O-ring is, in essence, extruded to a diamond shaped cross section.

The described view glass/flow indicator 32 has several features and advantages, certain of which will now be referenced in further detail.

Being located downstream of the main flow control popper 42, the static seal provided through the O-ring 100 is required to withstand, or seal, fuel pressures of only nominal magnitude during most of its duty cycle, when fuel is not being discharged from the nozzle. When the main popper is opened there will be a significant pressure that will be dependent on the pressure of the fuel immediately upstream of the main poppet 42 and the extent to which the popper is opened. However, under no circumstance, should the pressure on the static seal for the view glass be as much as the pressure upstream of the main popper.

The relatively low pressures and their intermittent application to the view glass seal, along with the described seal construction, provide an extremely high degree of reliability and virtually assure that there will no hazards incident to a leakage of fuel from the view glass.

Another safety factor attributable to locating the view glass flow indicators downstream of the main popper is that should there be some mishap, which caused the transparent disc to crack or fracture, there is but a minimal amount of fuel that can escape and become a hazard. Assuming that the nozzle otherwise maintains the integrity of the fuel passage upstream of the main poppet 42 and the main popper remains closed, the only fuel that could escape is that which is trapped between the main poppet 42 and the venturi check valve 44.

A further feature of the invention is that view glass, flow indicators are provided on opposite sides of the nozzle 30. This provides a flow indicator that is readily visible whether the nozzle is being used by a right handed or a left handed person. Further, by having the flow indicators aligned, the rotor (flow indicator) is more visible. This is to point out that the visibility of a rotor 78, on one side of the nozzle is enhanced by light that comes through the view glass on the opposite side of the nozzle.

The view glass\flow indicator 32, at all times, permits the condition of the fuel in the nozzle to be observed. Thus, an oil company or service station operator can demonstrate, to customers, the high quality of the fuel and the absence of impurities. Further, when fuel is being delivered, the rotors 78 will be rotating to indicate such fact to the retail customer, and, among other things, serve as a reminder not to remove the nozzle spout from a fill pipe, without releasing the lever 40 to close the main poppet 42.

One further point to note in connection with the view glass\flow indicator 32 is the deflector 86. If flow velocity vectors on opposite sides (normal to flow direction) of the rotor 78 are equal, there will not be a torque force on the rotor to cause its rotation and thus provide a visual indicator of fuel flow. The flow velocity vectors across the fuel flow path in a nozzle can vary widely, for a variety of reasons, and in some cases can result in a balancing of vectors such that the rotor 78 does not rotate when fuel is being discharged from the nozzle.

The purpose and function of the deflector 86 is to direct fuel flow to that it impinges the blades of the rotor when they are below the axis of the pin 80. This assures that even at low flow rates, there will be sufficient torque to rotate the rotor 78 and provide an indicator that fuel is flowing.

In order to assure that the deflector is properly oriented in the fuel flow passage 52, the cage 82 is provided with a lug 102 (FIG. 2), projecting from the ring portion 84, that is received by a corresponding notch in the opening into which the cage subassembly is inserted. This angularly orients the cage 52 relative the body 36 to assure rotation of the rotor 78.

FIGS. 5–7

Figure 5:
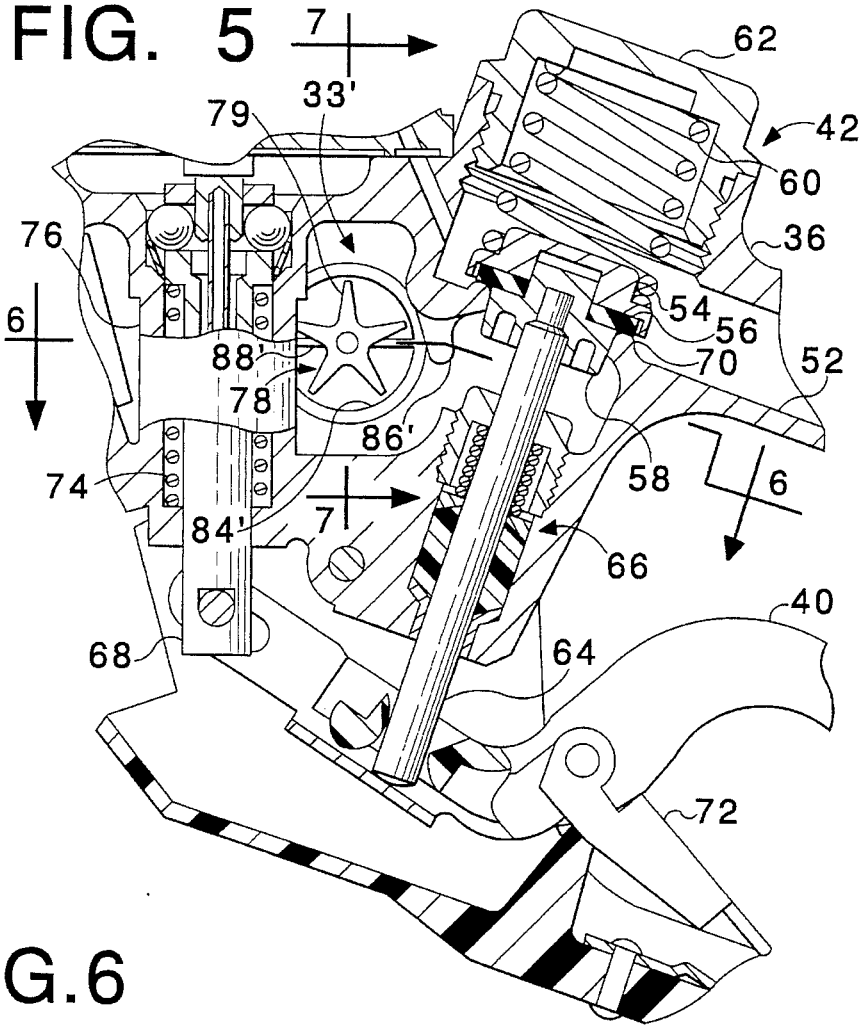
FIG. 5 is a longitudinal section, similar to FIG. 2, illustrating an alternate embodiment of the invention in which flow deflectors are formed integrally with the nozzle housing.
Figure 6:
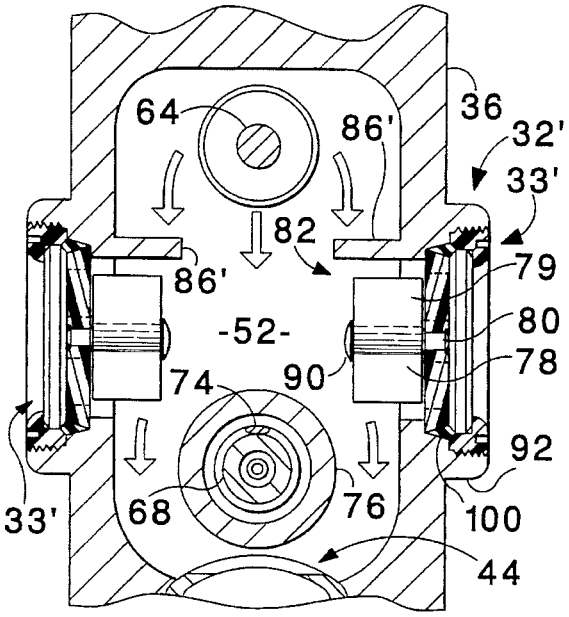
FIG. 6 is section taken on line 6—6 in FIG. 5.
Figure 7:
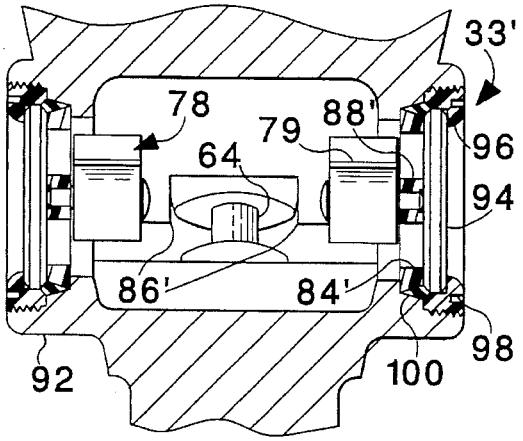
FIG. 7 is a section taken on line 7—7 in FIG. 5.

FIGS. 5–7 illustrate a modification of the view glass/flow indicator (32) of FIGS. 1–4. In this modification, the flow deflector (86) that assures an imbalance of flow forces and rotation of the flow indicating rotor (78) is built into the flow passage (52) rather than being built into the subassembly that comprises the rotor (78).

The view glass flow indicator of the present embodiment is generally identified by reference character 32' and comprises two view glass/flow indicator units 33'. With two modifications, the fuel nozzle 30, and particularly the nozzle body 36 are the same as in the first embodiment. The common components of the nozzle of this embodiment are identified by like reference characters and a detailed description is not deemed necessary for an understanding of this embodiment of the invention. Also, those components of the view glass/flow indicator 32' and the view glass/flow indicator units 33', which are common to the flow indicator 32 and view glass units 33 are also identified by like reference characters and will be referenced only to the extent necessary for an understanding of this modification.

In this modification, the cage (82) of the previous embodiment is eliminated excepting for a ring portion 84' found in each view glass/flow indicator unit 33'. A rotor 78 is mounted on a pin 80, as before, with the pin being mounted on an integral cross arm 88' that spans the ring portion 84'. The ring portion 84', pin 80 and rotor 78 likewise comprise a subassembly that is mounted in the same fashion as the previous embodiment. Thus a retaining ring 96 is threaded into a boss 92 to engage a transparent disc 94 and press it against the ring portion 84' and thereby maintain the rotor subassembly in its installed position in a counterbored opening in the nozzle body 36. A seal 100 provides a seal for the view glass in the same fashion as before.

The nozzle body 36, of this embodiment, is modified by the provision of a flow deflector 86' that is provided upstream of each of the rotors 78. The deflectors 86' block and direct fuel flow so that the primary fuel flow vectors impinge only on the vanes of the rotors when the vanes are in their lower positions. The deflectors 86' may be economically provided by modifying the core that defines the fuel flow passage 52, when producing the nozzle body by a casting process.

From a functional standpoint the rotor subassembly for each of the view glass units 33' is operative irrespective of its angular orientation relative to the fuel flow stream. Therefore, the angular positioning lug 102 of the previous embodiment and the notch in which it was received, are not provided in this embodiment.

The functions and advantages of this embodiment are essentially the same as in the previous embodiment.

FIGS. 8–10

Figure 8:
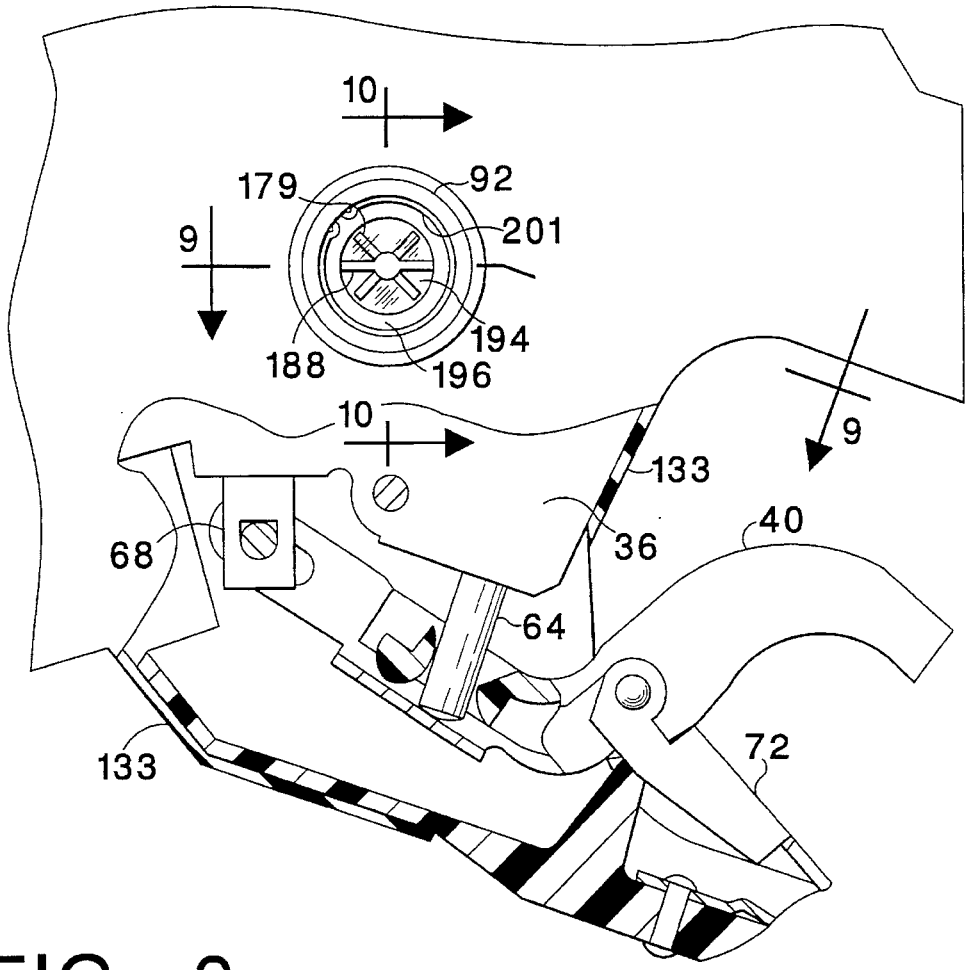
FIG. 8 is a fragmentary elevation, with portions broken away, of a nozzle that includes another view glass/flow indicator embodiment of the invention.
Figure 9:
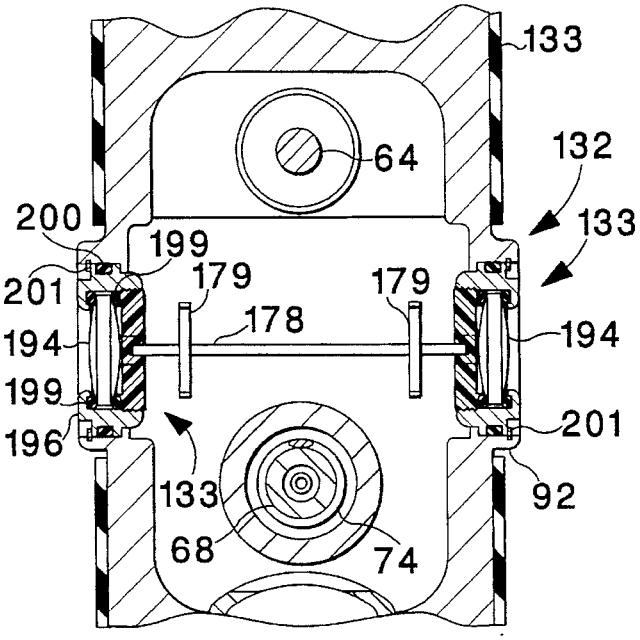
FIG. 9 is a section taken on line 9—9 in FIG. 8.
Figure 10:
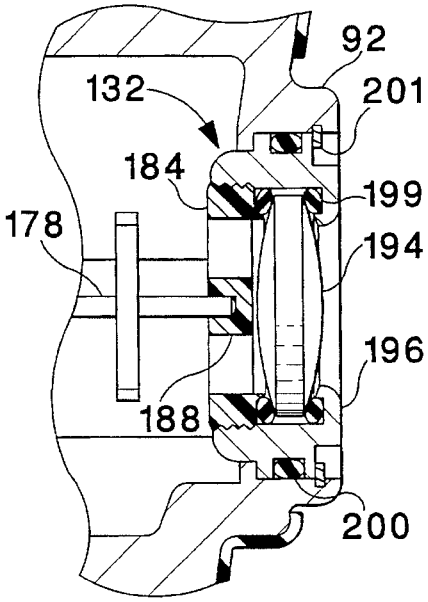
FIG. 10 is a section taken on line 10—10 in FIG. 8.

FIGS. 8–10 illustrate a view glass/flow indicator 132 which differs from the previous embodiments in that there is a single rotor 178, with view glasses being provided on opposite sides of the nozzle. The common components of the nozzle of this embodiment are identified by like reference characters and a detailed description is not deemed necessary for an understanding of this embodiment of the invention.

Thus, the nozzle components aside from the view glass, flow indicator 132 are the same as before, being existing components modified only to the extent of providing aligned openings, in the body 36, for mounting of the view glass/flow indicator 132. This embodiment also illustrates an alternate approach to obtaining a fluid seal for the view glass openings.

In brief the view glass/flow indicator 132 comprises two view glass subassemblies 133 and the single rotor 178.

Each of the view glass subassemblies (133) comprises a transparent disc 194, a disc holder 196 and a retaining ring 184. The retaining ring is threaded into the disc holder 196 to clamp the transparent disc 194 against an inturned lip of the disc holder. O-rings 199 clamped, respectively, between the disc 194 and the retaining ring 184 and the disc holder 196, provide a liquid seal for the transparent disc 194. An O-ring 200, in a circumferential groove in the disc holder 196 provides a liquid seal between the disc holder 196 and the nozzle body.

In assembly the view glass/flow indicator 132, one of the view glass subassemblies 133 is inserted into a counterbored opening nozzle body boss 92 and retained therein by a split retaining ring 201. At this point it will be noted that the retaining rings 184 include an integral cross bar 188. Holes disposed centrally of these cross bars receive the ends of the rotor 178 and serve as journals for rotatable mounting the rotor.

Thus, after one of the subassemblies 133 has been mounted on the nozzle body, the rotor is inserted through the opening in the opposite boss 92 and engaged with the cross bar 188 of the installed subassembly 133. The opposite end of the rotor 178 is engaged with the cross bar 188 of the other subassembly 133 is mounted in the opening in the other boss 92.

The nozzle 30, in FIGS. 8–10, also illustrates the conventional provision of a scuff guard 131. The scuff guard 131 is formed of a relatively soft, elastomeric material and is provided to minimize marring of the finish of vehicles when the nozzle makes contact therewith. It will be noted that the scuff guard 131 is provided with openings through which the bosses 92 protrude so that the view glass flow indicating means are readily available by the person using the nozzle.

It is to be noted that vanes 179 are provided adjacent the opposite ends of the rotor 178. The vanes give a readily apparent indication of rotation of the rotor 178 when it is rotated by fuel being discharged from the nozzle. This visual indication is enhanced by the convex configuration of the transparent disc 194, which provides a magnifying lens affect.

As previously indicated, some flow passage configurations cause variations in flow vector distribution across the height or width of the flow passage. In such case, a flow deflector is not required. In this embodiment, it is assumed that the flow vector distribution is such that the flow forces on the rotor 178 will be unbalanced and cause its rotation. If such is not the case, then deflector means may be provided in accordance with the teaching of the previous embodiments

FIGS. 11 & 12

Figure 11:
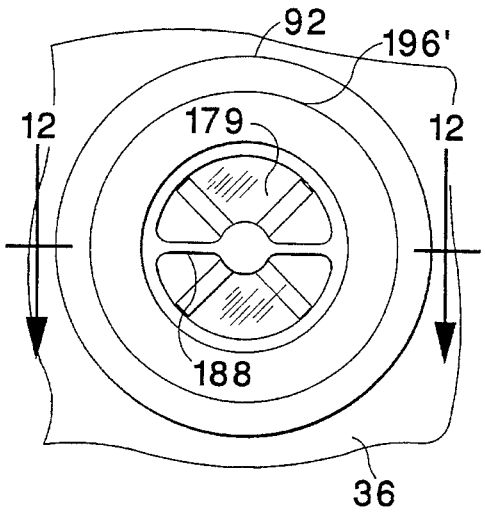
FIG. 11 is a fragmentary elevation of a nozzle, illustrating a modification of the embodiment of FIGS.; 8–10.
Figure 12:
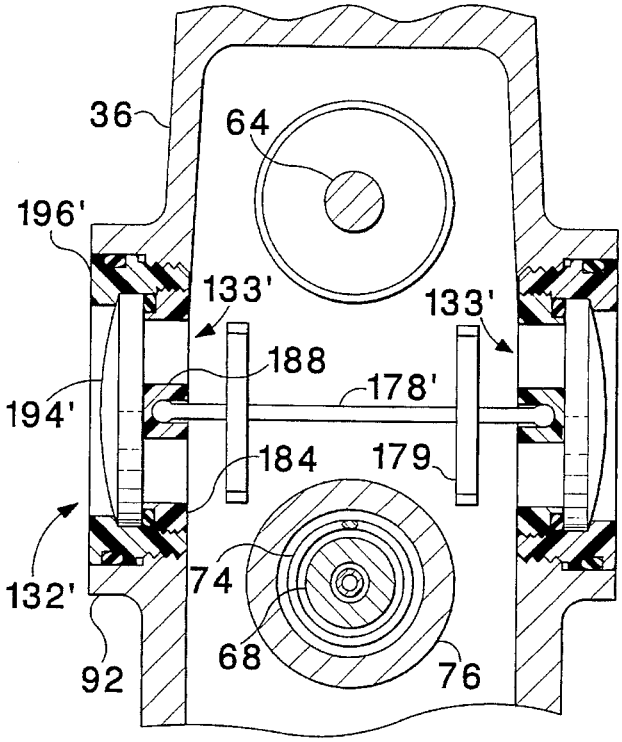
FIG. 12 is a section taken on line 12—12 in FIG. 11.

FIGS. 11 and 12 illustrate a view glass, flow indicator 132' that is the same as the previous embodiment (FIGS. 8–10) in employing a single rotor 178'.

This embodiment differs in the construction of view glass subassemblies 133'. Thus, each of the subassemblies 133' comprises a transparent disc 194' which is mounted in a disc holder 196', by a retaining ring 184 that is threaded into the disc holder 196'. A single O-ring 199 provides a liquid seal between the retaining ring 184 and the transparent disc 194'. An O-ring 200, disposed in a circumferential groove on the disc holder 196', provides a liquid seal between the disc holder 196' and the nozzle body 36.

This subassembly is mounted on the nozzle body by threaded it into openings in the bosses 92. Assembly of the view glass/flow indicator 132' is the same as in the previous embodiment. First, one of the view glass subassemblies 133' is mounted in the opening of one of the bosses 92. The one end of the rotor 178 is inserted in a socket journal formed the cross bar 188 of the retaining ring of the mounted subassembly 133'. The second subassembly 133' is then mounted in the opening in the other boss 92, with the opposite end captured in the journal of the cross bar 188 of the retaining ring 184 of the second subassembly.

It is to be noted that the ends of the rotor 178 have a spherical configuration. This provides a preferred journal, for the rotor 178', which minimizes the possibility of the shaft binding in its journals due to any misalignment of the sockets formed in the cross bars 188.

It will also be noted that the transparent disc 194 is in the form of a plano-convex lens, illustrating an alternate way of enhancing the visibility of rotor movement through a magnifying lens.

FIG. 13 & 14

Figure 13:
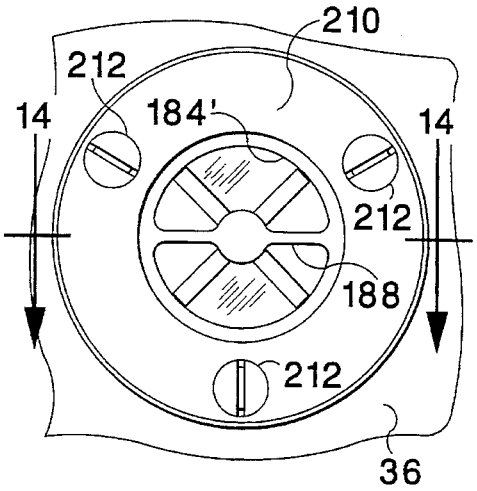
FIG. 13 is a fragmentary elevation of a nozzle, illustrating another modification of the embodiment of FIGS. 8–10.
Figure 14:
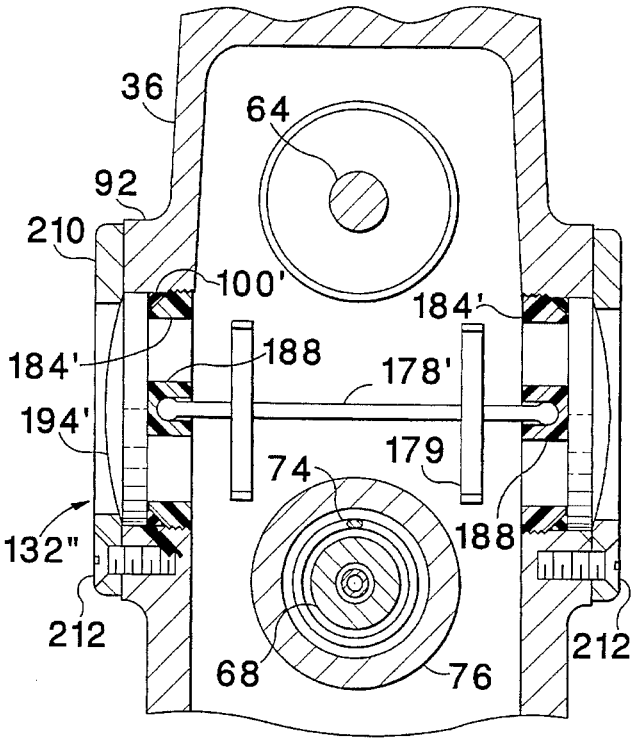
FIG. 14 is a section taken on line 14—14 in FIG. 13.

FIGS. 13 and 14 illustrate a view glass, flow indicator 132" that is the same as the two previous embodiments (FIGS. 8–10 and 11–12)) in employing a single rotor 178'.

This embodiment differs from the previous two embodiments in that there is no view glass subassembly (133 or 133'). Instead the journals for the rotor 178' are provided by rings 184' that are threaded into the openings in the bosses 92. The rings 184' have sockets that receive the spherical ends of the rotor 178'. Assembly is similar to the previous two embodiments in that one ring 184' is mounted, then one end of the rotor is inserted in the socked of the cross bar of that ring. The second ring 184' is then threaded into the opening in the other boss 92, with the opposite end of the rotor shaft captured in the socket of the cross member of the second ring 184'.

The ring members 184' are threaded into the boss openings a distance sufficient for transparent discs 194' to be positioned in these openings. Each disc 184' is then held in place by a retaining disc 210 that is secured to the nozzle boss 92 by screws 212.

A single O-ring 100' provides a liquid seal for each of the view glasses. Thus the outer sides of the rings 184' are beveled to form an annular space of triangular cross section, in combination with the disc 194' and the boss 92. A standard O-ring (100) of circular cross section is positioned in the boss opening before the disc 194' is inserted. Then when the retaining disc 210 is secured in place, by tightening the screws 212, the O-ring 100' is compressed and extruded to fill this triangular, annular cavity and provide a liquid seal for the view glass.

Again, if deflector means are required to assure rotation of the rotor 178', in a given fuel passage configuration, they can be added in accordance with earlier teachings herein.

FIG. 15

The view glass, flow indicator 132''' shown in FIG. 15 is a modification of the embodiment of the embodiment of FIGS. 11 and 12 in that it employs a single rotor 178''' and a view glass subassemblies 133''' that are threaded into openings in the nozzle body 36'.

The embodiment of FIG. 15 differs from prior embodiments in that the nozzle body does not have bosses (92) which permit the journals for the rotor to be aligned on a common axis. In other words, there has been a minimum modification in the standard nozzle body. At a transverse plane, intermediate the main poppet 42 and trip stem housing 76, where it is desired to locate the view glass/flow indicator, the sides of a standard nozzle body 36''' are angled downwardly toward each other, as illustrated. In this embodiment, the openings, in which the view glasses (transparent discs 194') are to be mounted, are horizontally aligned, but are formed normal to the side surfaces of the nozzle body and angled, at a low angle, relative to each other.

Each view glass subassembly 133''' comprises a transparent disc 194', a disc holder 196''' and a retaining ring 184. The retaining ring 184 is threaded into the disc holder 196''' to secure the transparent disc 194' to the disc holder 196''', with O-rings 199 providing a liquid seal therebetween. The subassemblies 133''' are mounted on the nozzle body 36''' by being threaded through the above referenced horizontally aligned openings. An O-ring 200''' provides a liquid seal between the disc holder 196''' and the nozzle body 36'''.

Assembly is as previously described. One of the subassemblies 133''' is mounted on the nozzle body 36'''. The rotor 178''' is then positioned so that one of its spherical ends engages a spherical seat in a cross bar 188''' in the retaining ring 184''' of the installed subassembly 133'''. The other subassembly 133''' with the opposite spherical end of the rotor 133''' engaged with the spherical seat in the cross bar 188''' of that retaining ring.

If desired, the rotor 178''' may comprise two telescoped portions, with spring means urging them outward to yieldingly maintain the spherical ends of the rotor 178''' in engagement with the spherical seats of the cross bars 188'''. This would maintain the ends of the rotor in its spherical journals, over a reasonable range of variation in the distance between the cross bar seats.

FIGS. 16–18

Figure 3:
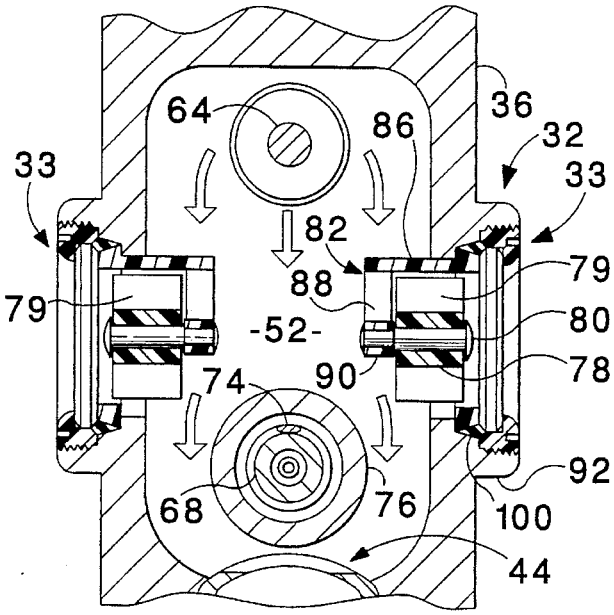
FIG. 3 is a section taken generally on line 3—3 in FIG. 2.
Figure 16:
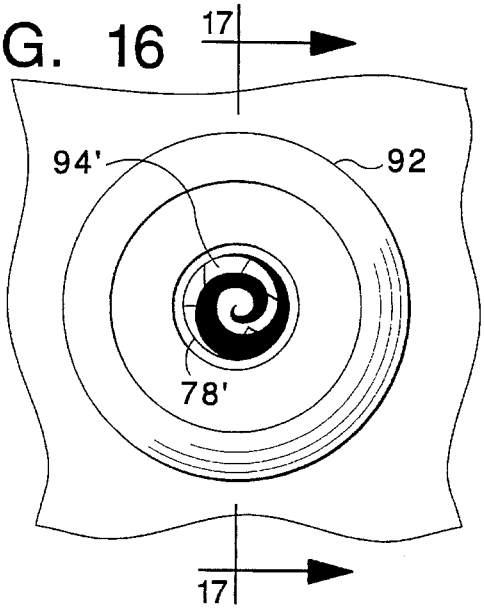
FIG. 16 is a fragmentary elevation illustrating a modification of the embodiment of FIGS. 2–4.
Figure 17:
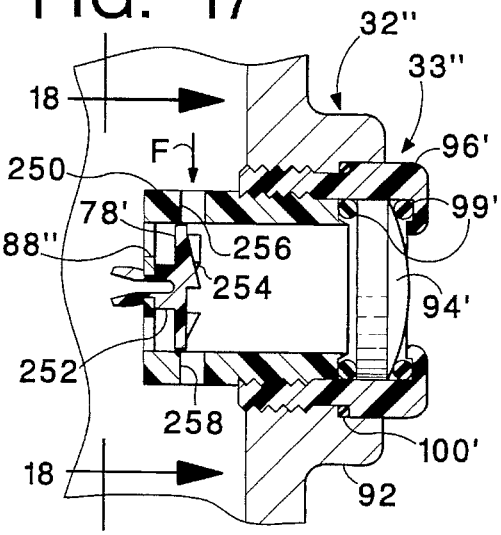
FIG. 17 is a section taken on line 17—17 in FIG. 16.

The view glass/flow indicator 32" of FIGS. 16 and 17 is similar to the first described embodiment (FIGS. 1–4) in that it comprises two view glass/flow indicating units 33". In FIGS. 16 and 17 only one of the view glass/flow indicator units 33" is illustrated. It is to be understood that an identical, or similar unit would be provided on the opposite side of the nozzle body, as illustrated in FIG. 3.

In this embodiment, each view glass/flow indicator unit 33" is a subassembly comprising a rotor 78' and a tubular rotor mount 250 that is threaded into a disc holder 96' to clamp a transparent disc 94' (magnifying view glass) against an inturned lip of the disc holder 96'. O-rings 99', on opposite sides of the disc 94', provide a liquid seal between the disc 94' and the disc holder 96' and the rotor mount 250, the latter seal being the more critical. The described subassembly 33" is mounted on the nozzle body 36 by being threaded into an opening in a boss 92. An O-ring 100" provides a seal between the holder 96' and the boss 92'.

Figure 18:
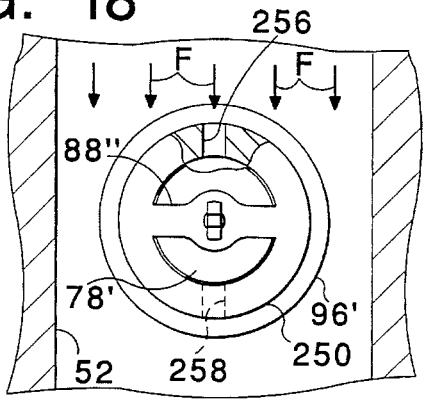
FIG. 18 is a view taken on line 18—18 in FIG. 17.

The inner end of the rotor mount 250 is thus positioned in the fuel flow passage 52, as illustrated in FIGS. 17 and 18. The rotor 78' has an integral shaft 252 that extends inwardly of the fuel passage 52 and is rotatably mounted on a cross bar 88" that spans the inner end of the rotor mount 250. The shaft 252 is longitudinally split and provided with a circumferential groove. The ends of the shaft can be pressed together and the forced through the opening in the cross bar 88" to a position in which the cross bar is received in the groove in the shaft 252. This provides an economical journal of the rotor 78' on the rotor mount 250, while maintaining it in a fixed axial position.

The rotor 78' is provided with a helical configuration on its outwardly facing surface, indicated at 254. Fluid flow is indicated by arrows F in FIGS. 17 and 18. A portion of this fluid flow is directed, through a passage 256, against the helical configuration 254 to cause it to rotate and provide a visual indication of fuel flow. The fuel that impinges the helical configuration 254 then exits the tubular rotor mount 250, through a passage 258.

As indicated above, there is, preferably, a similar, if not identical view glass/flow indicator unit 33" mounted on the opposite side of the flow passage 52. By employing the cross bar 88" and with the view glass/flow indicator units 33" generally aligned, light is transmitted through the fuel flow stream to facilitate a view of the fuel and the flow indicator, i.e., the rotor 78'. This visual affect can be enhanced by forming the rotor 78' for each unit of a transparent or translucent material. Visual effects may also be enhanced by providing a contrasting color pattern on the helical configuration 254, as indicated in FIG. 16.

FIGS. 19–21

Figure 19:
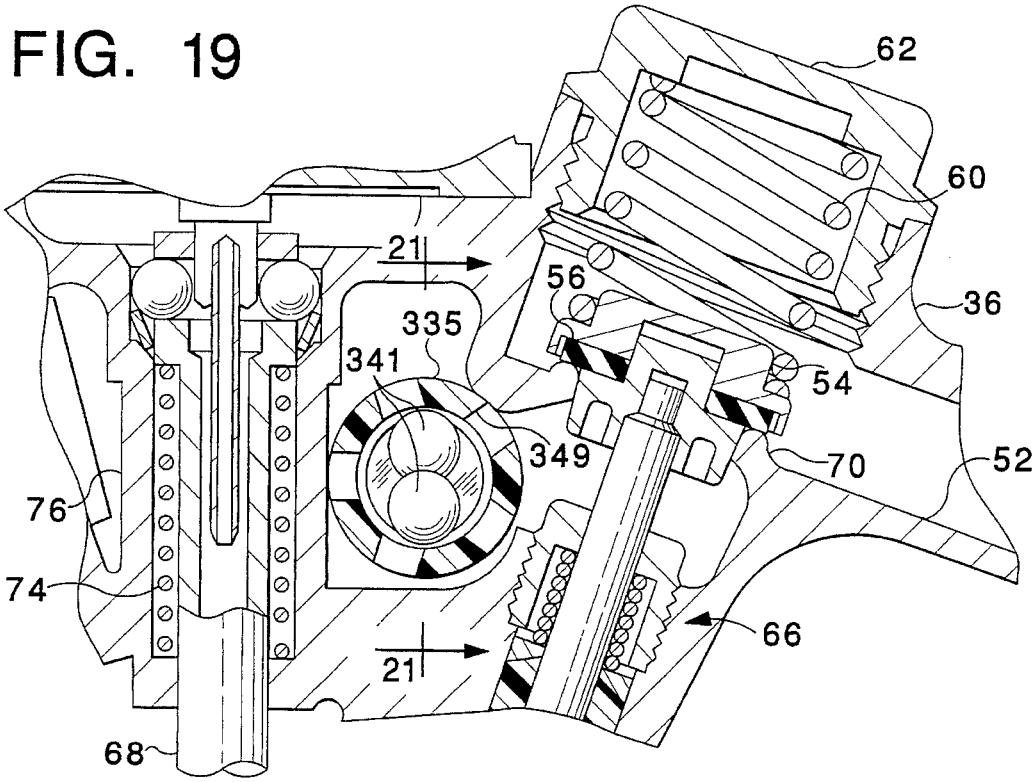
FIG. 19 is a longitudinal section similar to FIG. 2, illustrating yet another alternate embodiment of the invention in which balls are employed to provide an indication of fuel flow.
Figure 20:
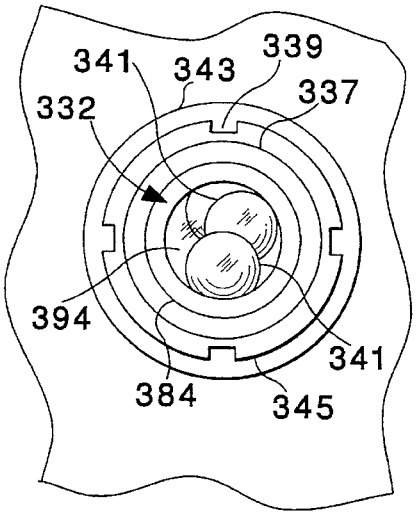
FIG. 20 is a fragmentary elevation of the nozzle and view glass of FIG. 19
Figure 21:
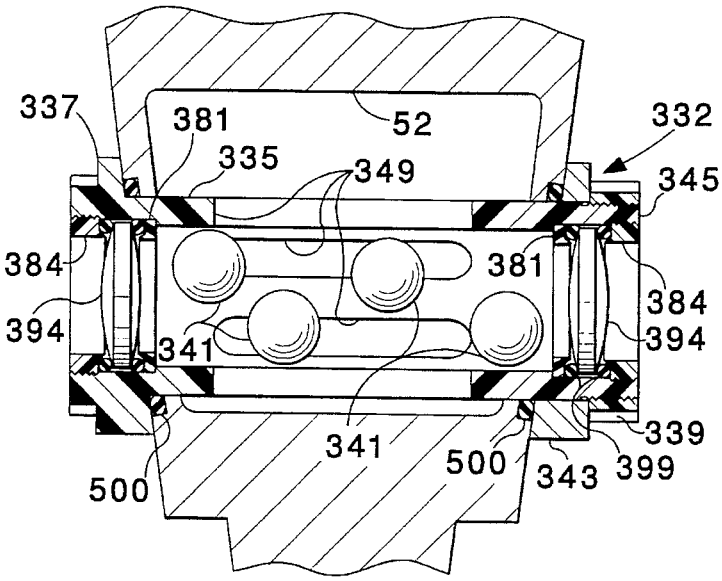
FIG. 21 is a section taken on line 21—21 in FIG. 19.

A view glass/flow indicator 332 is illustrated in FIGS. 19–21 mounted on a fuel nozzle which contains the same functional components for controlling the flow of fuel and providing an automatic shut-off feature as described in connection with FIGS. 1–4. Like reference characters are employed to identify these common components and further description thereof will be limited to any interrelationship with the view glass/flow indicator 332.

The nozzle body 36 is in its unmodified condition. That is, the sides of the nozzle (FIG. 21) in a plane, normal to the direction of fuel flow, between the main popper 42 and trip stem housing 76, are tapered, as discussed in connection with FIG. 15.

The view glass/flow indicator 332 comprises a tubular housing 335 that is inserted through aligned openings in the angled, body side walls, which define the fuel flow passage in this area of the nozzle. Tubular housing 335 is provided with an enlarged head, or flange, 337, the inner surface of which is angled on the same angle as the adjacent side wall of the nozzle body. The head 337 is also provided with slots 339 that facilitate the application of a torquing force thereto by a spanner wrench.

The tubular housing is a part of a subassembly that includes view glasses (transparent discs) at its opposite ends. Thus, at each end, there is a convex-convex transparent disc 394. Each disc 394 is forced toward a seating ring 381 by a retaining ring 384 threaded into the ends of the tubular housing 335. The transparent discs 394 are sealed relative to the housing 335 and the retaining rings 384 by O-rings 399.

This subassembly also comprises a plurality of flow indicating members which take the form of balls 341, that are preferably formed of synthetic resin.

This subassembly may be inserted through the openings in the walls of the nozzle body 36 in installing the view glass/flow indicator 332. A washer 343 is then telescoped over the projecting end portion of the housing 335. The washer has a central opening that approximates the outer diameter of the tubular housing 335. The inner surface of the washer, facing the nozzle body, is angled on an angle matching that of the body wall that it faces. The outer face of the washer 343 is normal to its central opening. A nut 345 is then threaded onto the end of the housing 335 and through the angled surfaces of the head 337 and the washer 343, exerts a substantial uniform force on the side walls of the nozzle body, and particularly on O-rings 500 that provide a liquid seal between the housing 335 and the nozzle body walls. The nut 345 may also be provided with slots 347 that facilitate the application of a torque force by means of a spanner wrench.

The housing 335 is provided with a series of slots 349 that provide for fuel flow through the interior of the housing, when the main popper 42 is open. This flow has sufficient inherent turbulence to impart movement to the balls 341 and thus give a visual indication that fuel is being discharged from the nozzle.

It is to be appreciated that many of the features described in connection with one embodiment may be used in other embodiments. It is also to be appreciated that modification of the specific embodiments described will occur to those skilled in the art, within the spirit and scope of the invention, as defined in the following claims.

It will also be noted that view glass/flow indicating means of the present invention uniquely adapt to a vapor recovery nozzle construction which has the additional feature of a vapor return flow path which passes above the fuel flow path through the nozzle body. In its broader aspects, the invention is not limited to vapor recovery nozzles, or to vapor recovery nozzles having this relation of the vapor return flow path to the fuel flow path.

Having thus described the invention, what is claimed as novel and desired to be secured by Letters Patents of the United States is:

1. A fuel dispensing nozzle comprising a nozzle body, one end of which is adapted for connection with a fuel hose, a spout projecting from another end of the nozzle body for the discharge of fuel from the nozzle, a main fuel passage, extending, through the nozzle body, from the inlet end to and through the spout for discharge of fuel therefrom, said main fuel passage defining the flow path for at least substantially all of the fuel flowing from the inlet end of the nozzle body to the spout, a main valve for controlling the flow of fuel through the fuel passage, view glass/flow indicator means for providing visual inspection of said substantially all the fuel flowing through said passage and a visual indication that fuel is being discharged from the nozzle spout and at what rate, characterized in that the view glass/flow indicator means define, in part, the fuel passage and are disposed downstream of the main valve.

2. A fuel dispensing nozzle as in claim 1, further comprising a check valve downstream of the main valve, and further characterized in that the view glass/flow indicator means is disposed intermediate the main valve and the check valve, whereby the view glass/flow indicator means, disposed in and forming part of the fuel passage, is wetted by fuel at all times during normal operation of the nozzle.

3. A fuel dispensing nozzle as in claim 2, further comprising a spring for urging said main valve to a closed position, manually controlled means for opening said main valve against the force of said spring, and means for automatically closing said main valve to prevent overfilling of a vehicle tank, the automatic closing means including a generally vertically disposed pin that is positioned in a plane that is generally, longitudinal of and central relative to the flow passage, the nozzle body having a pin housing portion in which said pin is disposed, with the fuel passage being split for flow around said housing portion, said split flow passage being rejoined, downstream of the housing portion for flow past the check valve, further characterized in that the view glass/flow indicator means is disposed intermediate the main valve and said pin housing portion.

4. A fuel dispensing nozzle as in claim 3, further characterized in that the view glass/flow indicator means comprise a pair of view glasses, disposed in generally horizontally aligned relation and, respectively, defining opposed portions of the flow passage, whereby light may pass from one side of the nozzle body to the other, through the fuel passage, to enhance visual inspection of the fuel and observation of the flow indicator means.

5. A fuel dispensing nozzle as in claim 4 further characterized in that opposed portions of the side walls of the nozzle body, that define the fuel passage, downstream of the main valve, are provided with horizontally aligned openings and the view glass/flow indicator means comprise a pair of transparent discs mounted, respectively, in said openings, and a pair of flow indicator units mounted, respectively in said openings for viewing through said transparent discs.

6. A fuel dispensing nozzle as in claim 3, further characterized in that the view glass/flow indicator means comprise a single rotor spanning the fuel flow passage immediately upstream of said pin housing portion.

7. A fuel dispensing nozzle as in claim 3, further characterized in that the view glass/flow indicator means comprise a view glass, defining a portion of the main flow passage, a cage disposed immediately upstream of the pin housing portion, axially aligned with the view glass, and permitting flow of fuel therethrough, when the main valve is open, and at least one solid member disposed within said cage, and movable in response to flow of fuel through said cage to provide a visual indication of fuel flow.

8. A fuel dispensing nozzle as in claim 1, further characterized in that the view glass/flow indicator means comprise a pair of view glasses, disposed in generally horizontally aligned relation and, respectively, defining opposed portions of the flow passage, whereby light may pass from one side of the nozzle body to the other, through the fuel passage, to enhance visual inspection of the fuel and observation of the flow indicator means.

9. A fuel dispensing nozzle as in claim 8, further characterized in that opposed portions of the side walls of the nozzle body, that define the fuel passage, downstream of the main valve, are provided with horizontally aligned openings and the view glass/flow indicator means comprise a pair of transparent discs mounted, respectively, in said openings.

10. A fuel dispensing nozzle as in claim 9, further characterized in that the view glass/flow indicator means comprise a pair of flow indicator units mounted, respectively in said openings for viewing through said transparent discs.

11. A fuel dispensing nozzle as in claim 10, further characterized in that the transparent disc and the flow indicator means mounted in each opening comprise a subassembly that can be mounted in and removed from the opening therefor as a unit.

12. A fuel dispensing nozzle as in claim 11, further characterized in that each transparent disc/flow indicator means subassembly comprises a tubular disc holder and a tubular mounting member for the flow indicating means, and the mounting member is secured on said disc holder and the disc holder is removably secured in one of the openings in the nozzle body.

13. A fuel dispensing nozzle as in claim 12, further characterized in that, for each subassembly, the disc holder has an inturned lip, the mounting member secured thereto is threaded therein, the transparent disc is captured between the mounting member and inturned lip, O-rings are provided on opposite sides of the transparent disc to provide seals between the transparent disc and the lip and the mounting member, and the disc holders are threadably engaged in said aligned openings.

14. A fuel dispensing nozzle as in claim 10, further characterized in that each flow indicator is in the form of a subassembly comprising a vaned rotor, a mounting ring, and means for rotatably mounting the rotor on the mounting ring.

15. A fuel dispensing nozzle as in claim 14, further characterized in that each mounting ring includes a deflector portion that partially shields the rotor of the subassembly from flow fuel so that fuel will impact on the vanes of the rotor on one side thereof, to assure rotor rotation, and the means for pivotally mounting the rotor comprise spokes extending radially inward from the deflector portion and a pin, extending longitudinally from the spokes, on which the rotor is mounted.

16. A fuel dispensing nozzle as in claim 14, further characterized in that each of said openings if formed with a counterbore, each mounting ring has an outer, annular portion seated on the counterbore of one of said openings, a retaining ring is secured on the nozzle body in registered relation to said mounting ring, the transparent disc for that opening is captured between the retaining ring and mounting ring, and further characterized in that, for each opening, a single O-ring provides a fluid seal between the nozzle body, the retaining ring, the mounting ring and the transparent disc.

17. A fuel dispensing nozzle as in claim 16, further characterized in that each O-ring is compressed in an annular cavity having a generally diamond shape cross section and defined by surfaces of the mounting ring, nozzle body, retaining ring and the transparent disc associated with a given opening, and each retaining ring is threaded into the nozzle body.

18. A fuel dispensing nozzle as in claim 14, further characterized in that the fuel passage includes deflector portions that partially shield the rotors of the subassembly from flow fuel so that fuel will impact on the vanes of the rotor on one side thereof, to assure rotor rotation.

19. A fuel dispensing nozzle as in claim 8, further characterized in that the view glass/flow indicator means comprise flow indicator means comprising a single rotor.

20. A fuel dispensing nozzle as in claim 19, further characterized in that each view glass comprises a transparent disc, retaining ring and a mounting ring, between which the transparent disc is mounted, and the single rotor extends between and is journaled on said mounting rings.

21. A fuel dispensing nozzle as in claim 20, further characterized in that each mounting ring has a cross bar, and the single rotor is journaled centrally of the cross bar.

22. A fuel dispensing nozzle as in claim 21, further characterized in that opposed portions of the side walls of the nozzle body, that define the fuel passage, downstream of the main valve, are provided with horizontally aligned, coaxial openings, and each journal comprises coaxially bores in said cross bars, and the opposite ends of the rotor have spherical portions that are received by said coaxial bores.

23. A fuel dispensing nozzle as in claim 21, further characterized in that opposed portions of the side walls of the nozzle body, that define the fuel passage, downstream of the main valve, are provided with horizontally aligned, openings, said aligned openings are formed on axes which are at a relatively low angle to each other, and each journal comprises spherical seats formed centrally of said cross bars, and the opposite ends of the rotor have spherical portions that are received by said spherical spats.

24. A fuel dispensing nozzle as in claim 20, further characterized in that each view glass comprises a subassembly wherein the mounting ring is mounted on the retaining ring and holds the transparent disc in assembled relation therebetween, and O-ring means for providing a fluid seal that prevents leakage of fuel past the transparent disc other O-ring means provide a fluid seal that prevents leakage of fuel between the retaining ring and the nozzle body.

25. A fuel dispensing nozzle as in claim 24, further characterized in that opposed portions of the side walls of the nozzle body, that define the fuel passage, downstream of the main valve, are provided with horizontally aligned, openings, and a view glass assembly is mounted in each of the aligned openings, and also characterized in that in each view glass subassembly the retaining ring has an inturned lip, the mounting ring is threaded into the retaining ring and captures the transparent disc between the mounting ring and the inturned lip of the retaining ring, the O-ring means for providing a fluid seal that prevents leakage of fuel past the transparent disc, comprise an O-ring disposed between the end of the mounting ring and the transparent disc and an O-ring disposed between the transparent disc and the inturned lip, and the other O-ring means comprise an O-ring disposed between an outer diameter of the retaining ring and the aligned opening.

26. A fuel dispensing nozzle as in claim 8, further characterized in that the view glass/flow indicator means comprise a cage extending between the view glasses and permitting flow of fuel therethrough, when the main valve is open, and at least one solid member, disposed within said cage, movable in response to flow of fuel through said cage to provide a visual indication of fuel flow.

27. A fuel dispensing nozzle as in claim 26, further characterized in that the cage is in the form of a tubular member spanning the fuel flow passage, and having passages therein, for the flow of fuel transversely through the tubular member, and a plurality of solid members are disposed within the tubular member.

28. A fuel dispensing nozzle as in claim 27, further characterized in that opposed portions of the side walls of the nozzle body, that define the fuel passage, downstream of the main valve, are provided with horizontally aligned openings, said tubular member extends through said openings and the view glasses comprise transparent discs mounted, respectively, at opposite ends of the tube, and means for clamping the opposite ends of the tubular member against opposite sides of the nozzle body at the aligned openings.

29. A fuel dispensing nozzle as in claim 28, further characterized in that the tubular member is provided with a head at one end, which is engageable with one side of the nozzle body, the opposite end of the tubular member projects outwardly of the opposite side of the nozzle body, nut means are threaded onto the opposite end of the tubular member to clamp the tubular member in sealed relation on the nozzle body.

30. A fuel dispensing nozzle as in claim 29, wherein the sides of the nozzle where the aligned openings are disposed are angled downwardly toward each other, the surface of the tubular member head, that faces the nozzle body, is formed on an angle corresponding to the angle of the side of the nozzle, and the nut means comprises a nut threaded onto the tubular member, and having end faces disposed in planes normal to the axis of the tubular member, and a washer disposed between the nut and the opposite, angled surface of the nozzle body, said washer having one end surface in opposed, parallel relation to an end face of the nut, and another end face in opposed, parallel relation to the adjacent surface of the nozzle body.

31. A fuel dispensing nozzle as in claim 28, further characterized in that the opposite ends of the tubular member are counterbored to form shoulders, retaining rings are threaded into the opposite ends of the tubular member and clamp the discs against the shoulders, and O-ring means are provided for preventing leakage of fuel outwardly from between the transparent discs and the tubular member.

32. A fuel dispensing nozzle as in claim 1, further comprising means for defining a vapor passage for returning fuel vapors from the spout to said one end of the nozzle body, said vapor passage being in overlying relation to the major portion of the nozzle body fuel passage, and further characterized in that the view glass/flow indicator means are disposed in underlying relation beneath the vapor passage.

33. A fuel dispensing nozzle comprising a nozzle body, one end of which is adapted for connection with a fuel hose, a spout projecting from another end of the nozzle body for the discharge of fuel from the nozzle, a fuel passage, extending, through the nozzle body, from the inlet end to and through the spout for discharge of fuel therefrom, a main valve for controlling the flow of fuel through the fuel passage, view glass/flow indicator means for providing visual inspection of the fuel flowing through said passage and a visual indication that fuel is being discharged from the nozzle spout and at what rate, wherein the view glass/flow indicator means define, in part, the fuel passage, and characterized in that the view glass/flow indicator means comprise a pair of view glasses, disposed in generally horizontally aligned relation and, respectively, defining opposed portions of the flow passage, whereby light may pass from one side of the nozzle body to the other, through the fuel passage, to enhance visual inspection of the fuel and observation of the flow indicator means, opposed portions of the side walls of the nozzle body, that define the fuel passage, downstream of the main valve, are provided with horizontally aligned openings and the view glass/flow indicator means comprise a pair of transparent discs mounted, respectively, in said openings, a pair of flow indicator units mounted, respectively in said openings for viewing through said transparent discs, each flow indicator is in the form of a subassembly comprising a vaned rotor, a mounting ring, and means for rotatably mounting the rotor on the mounting ring.

34. A fuel dispensing nozzle comprising a nozzle body, one end of which is adapted for connection with a fuel hose, a spout projecting from another end of the nozzle body for the discharge of fuel from the nozzle, a fuel passage, extending, through the nozzle body, from the inlet end to and through the spout for discharge of fuel therefrom, a main valve for controlling the flow of fuel through the fuel passage, view glass/flow indicator means for providing visual inspection of the fuel flowing through said passage and a visual indication that fuel is being discharged from the nozzle spout and at what rate, wherein the view glass/flow indicator means define, in part, the fuel passage, and characterized in that the view glass/flow indicator means comprise a pair of view glasses, disposed in generally aligned relation and, respectively, defining opposed portions of the flow passage, whereby light may pass through the fuel passage, to enhance visual inspection of the fuel and observation of the flow indicator means.

35. A fuel dispensing nozzle as in claim 34, further comprising means for defining a vapor passage for returning fuel vapors from the spout to said one end of the nozzle body, said vapor passage being in overlying relation to the major portion of the nozzle body fuel passage, and further characterized in that the view glass/flow indicator means are disposed in underlying relation beneath the vapor passage.

36. A fuel dispensing nozzle comprising a nozzle body, one end of which is adapted for connection with a fuel hose, a spout projecting from another end of the nozzle body for the discharge of fuel from the nozzle, a fuel passage, extending, through the nozzle body, from the inlet end to and through the spout for discharge of fuel therefrom, a main valve for controlling the flow of fuel through the fuel passage, view glass/flow indicator means for providing visual inspection of the fuel flowing through said passage and a visual indication that fuel is being discharged from the nozzle spout and at what rate, wherein the view glass/flow indicator means define, in part, the fuel passage, and characterized in that the view glass/flow indicator means comprise a pair of view glasses, disposed in generally horizontally aligned relation and, respectively, defining opposed portions of the flow passage, whereby light may pass from one side of the nozzle body to the other, through the fuel passage, to enhance visual inspection of the fuel and observation of the flow indicator means, and further characterized in that the view glass/flow indicator means comprise flow indicator means comprising of a single rotor.

37. A fuel dispensing nozzle as in claim 36, further comprising means for defining a vapor passage for returning fuel vapors from the spout to said one end of the nozzle body, said vapor passage being in overlying relation to the major portion of the nozzle body fuel passage, and further characterized in that the view glass/flow indicator means are disposed in underlying relation beneath the vapor passage.

38. A fuel dispensing nozzle comprising a nozzle body, one end of which is adapted for connection with a fuel hose, a spout projecting from another end of the nozzle body for the discharge of fuel from the nozzle, a fuel passage, extending, through the nozzle body, from the inlet end to and through the spout for discharge of fuel therefrom, a main valve for controlling the flow of fuel through the fuel passage, view glass/flow indicator means for providing visual inspection of the fuel flowing through said passage and a visual indication that fuel is being discharged from the nozzle spout and at what rate, wherein the view glass/flow indicator means define, in part, the fuel passage, characterized in that the view glass/flow indicator means comprise a pair of view glasses, disposed in generally aligned relation and, respectively, defining opposed portions of the flow passage, whereby light may pass through the fuel passage, to enhance visual inspection of the fuel and observation of the flow indicator means, and further characterized in that the view glass/flow indicator means comprise a cage extending between the view glasses and permitting flow of fuel therethrough, when the main valve is open and at least one solid member, disposed within said cage, movable in response to flow of fuel through said cage to provide a visual indication of fuel flow.

39. A fuel dispensing nozzle as in claim 38, further characterized in that the cage is in the form of a tubular member
spanning the fuel flow passage, and
having passages therein, for the flow of fuel transversely through the tubular member, and a plurality of solid members are disposed within the tubular member.

40. A fuel dispensing nozzle as in claim 39, further characterized in that opposed portions of the side walls of the nozzle body, that define the fuel passage, downstream of the main valve, are provided with horizontally aligned openings, said tubular member extends through said openings and the view glasses comprise transparent discs mounted, respectively, at opposite ends of the tube, and means for clamping the opposite ends of the tubular member against opposite sides of the nozzle body at the aligned openings.

41. A fuel dispensing nozzle as in claim 40, further characterized in that the tubular member is provided with a head at one end, which is engageable with one side of the nozzle body, the opposite end of the tubular member projects outwardly of the opposite side of the nozzle body nut means are threaded onto the opposite end of the tubular member to clamp the tubular member in sealed relation on the nozzle body.

42. A fuel dispensing nozzle as in claim 41, further characterized in that the opposite ends of the tubular member are counterbored to form shoulders, retaining rings are threaded into the opposite ends of the tubular member and clamp the discs against the shoulders, and O-ring means are provided for preventing leakage of fuel outwardly from between the transparent discs and the tubular member.

43. A fuel dispensing nozzle as in claim 38, further comprising means for defining a vapor passage for returning fuel vapors from the spout to said one end of the nozzle body, said vapor passage being in overlying relation to the major portion of the nozzle body fuel passage, and further characterized in that the view glass/flow indicator means are disposed in underlying relation beneath the vapor passage.

* * * * *